US010208951B2

(12) United States Patent
Maryamchik

(10) Patent No.: US 10,208,951 B2
(45) Date of Patent: Feb. 19, 2019

(54) SPRAY DRYER ABSORBER AND RELATED PROCESSES

(75) Inventor: Mikhail Maryamchik, Fairlawn, OH (US)

(73) Assignee: THE BABCOCK & WILCOX COMPANY, Barberton, OH (US)

( * ) Notice: Subject to any disclaimer, the term of this patent is extended or adjusted under 35 U.S.C. 154(b) by 395 days.

(21) Appl. No.: 11/854,795

(22) Filed: Sep. 13, 2007

(65) Prior Publication Data

US 2009/0074642 A1 Mar. 19, 2009

(51) Int. Cl.
*F23J 15/00* (2006.01)

(52) U.S. Cl.
CPC ..... *F23J 15/003* (2013.01); *F23J 2215/20* (2013.01); *F23J 2219/50* (2013.01)

(58) Field of Classification Search
None
See application file for complete search history.

(56) References Cited

U.S. PATENT DOCUMENTS 4,184,886 A * 1/1980 Ellingen et al. ..... 106/746
4,197,285 A 4/1980 Yang et al.
4,279,873 A 7/1981 Felsvang et al.
4,309,393 A 1/1982 Nguyen
4,325,327 A 4/1982 Kantesaria et al.
4,324,770 A 5/1982 Bakke
4,329,324 A 5/1982 Jones
4,387,653 A 6/1983 Voss
4,645,653 A * 2/1987 Kimura ..... 423/235
4,756,892 A 7/1988 Kragh et al.
4,867,955 A 9/1989 Johnson
4,980,138 A 12/1990 Samish
5,084,256 A 1/1992 McElroy et al.
5,100,643 A * 3/1992 Brna et al. ..... 423/240 R
5,137,753 A 8/1992 Bland et al.
5,171,552 A 12/1992 Miura et al.
5,270,015 A * 12/1993 Rochelle et al. ..... 422/168
5,320,051 A * 6/1994 Nehls, Jr. ..... 110/345
5,378,443 A 1/1995 Engstrom et al.
5,382,418 A 1/1995 Thone et al.
5,401,481 A * 3/1995 Rochelle et al. ..... 423/331
5,415,111 A 5/1995 Lewnard et al.
5,480,624 A 1/1996 Kuivalainen
5,551,357 A 9/1996 Wu et al.
5,635,149 A * 6/1997 Klingspor et al. ..... 423/243.08
5,662,051 A 9/1997 Morin
5,814,288 A * 9/1998 Madden et al. ..... 423/244.01
6,146,607 A 11/2000 Lavely, Jr.
(Continued)

OTHER PUBLICATIONS

Curran, R.A., et al., "Cold-Side Desulfurization by Humidification of Fly Ash in CFB Boilers," Fluidized Bed Combustion—vol. 2, ASME, United States, 1995, pp. 851-856.
(Continued)

*Primary Examiner* — Sheng H Davis
(74) *Attorney, Agent, or Firm* — Michael J. Seymour

(57) ABSTRACT

A spray dryer absorber (SDA) system used to reduce the concentration of at least one acid compound in a gas utilizes low or no alkali-containing particulate compounds to prevent cementing during operation. The low or no-alkali-containing compounds may be supplied from external sources and/or from a particulate collection device located downstream of the SDA.

19 Claims, 1 Drawing Sheet

(56) References Cited

U.S. PATENT DOCUMENTS

| | | | |
|---|---|---|---|
| 6,290,921 | B1 | 9/2001 | Kuivalainen et al. |
| 6,309,996 | B1 | 10/2001 | Fan et al. |
| 6,520,099 | B1 | 2/2003 | Furuya |
| 6,912,962 | B2 | 7/2005 | Morin et al. |
| 2002/0197199 | A1 | 12/2002 | Fan et al. |
| 2003/0151023 | A1 | 8/2003 | Trass et al. |
| 2005/0287058 | A1 | 12/2005 | Kinnunen |

OTHER PUBLICATIONS

Office Action No. 18421, dated Nov. 25, 2011 for corresponding Colombian Patent Application No. 08096707.
Office Action, dated Mar. 29, 2011 for corresponding Chinese Patent Application No. 200810213897.0.

* cited by examiner

SPRAY DRYER ABSORBER AND RELATED PROCESSES

FIELD AND BACKGROUND OF THE INVENTION

Field of the Invention

The present invention relates, in general, to the field of environmental pollution control equipment used to remove pollutants from gases produced during the combustion of fossil fuels and, more particularly, to spray dryer absorbers used to remove acid gas compounds from such gases. The gases may be produced by industrial processes as well as combustion processes used in the production of steam for electric power generation.

Description of the Related Art

Electric power generating plants and other industries that combust fossil fuels (e.g., coal, oil, petroleum coke, and/or waste materials) create various contaminants that include, among other things, acid gases (such as sulfur oxides) and other unwanted and/or undesirable chemical compounds in the flue gas produced during combustion.

One of the most common methods for reducing sulfur oxides in flue gases is through a spray drying chemical absorption process, also known as dry scrubbing, wherein an aqueous alkaline solution or slurry is finely atomized (via, for example, mechanical, dual fluid, or rotary atomizers), and sprayed into the hot flue gas to remove the contaminants. For a better understanding of spray drying chemical absorption processes, or dry scrubbing, the reader is referred to *STEAM its generation and use* , 41st Ed., Kitto and Stultz, eds., Copyright © 2005, The Babcock & Wilcox Company, particularly Chapter 35, pages 35-12 through 35-18, the text of which is hereby incorporated by reference as though fully set forth herein.

Spray dry absorption (SDA) reflects the primary reaction mechanisms involved in the process: drying alkaline reagent slurry atomized into fine droplets in the hot flue gas stream and absorption of $SO_2$ and other acid gases from the gas stream. The process is also called semi-dry scrubbing to distinguish it from injection of a dry solid reagent into the flue gas.

In a typical boiler installation arrangement, the SDA is positioned before the dust collector. Flue gases leaving the last heat trap (typically, air heater) at a temperature of 250° F. to 350° F. (121° C. to 177° C.) enter the spray chamber where the reagent slurry is sprayed into the gas stream, cooling the gas to 150° F. to 170° F. (66° C. to 77° C.). An electrostatic precipitator (ESP) or fabric filter (baghouse) can be used to collect the reagent, flyash and reaction products. Baghouses are the dominant selection for U.S. SDA installations (over 90%) and provide for lower reagent consumption to achieve similar overall system $SO_2$ emissions reductions.

$SO_2$ absorption takes place primarily while the water is evaporating and the flue gas is adiabatically cooled by the spray. Reagent stoichiometry and approach temperature are the two primary variables that control the scrubber's $SO_2$ removal efficiency. The stoichiometry is the molar ratio of the reagent consumed to either the inlet $SO_2$ or the quantity of $SO_2$ removed in the process. Depending upon available reagent and acid gas content in the flue gases, the stoichiometry can vary widely; e.g., from about 1 to more than 10. The difference between the temperature of the flue gas leaving the dry scrubber and the adiabatic saturation temperature is known as the approach temperature. Flue gas saturation temperatures are typically in the range of 115° F. to 125° F. (46° C. to 52° C.) for low moisture bituminous coals and 125° F. to 135° F. (52° C. to 57° C.) for high moisture subbituminous coals or lignites. The optimal conditions for $SO_2$ absorption must be balanced with practical drying considerations.

The predominant reagent used in dry scrubbers is lime slurry produced by slaking a high-calcium pebble lime. The slaking process can use a ball mill or a simple detention slaker. SDA systems that use only lime slurry as the reagent are known as single pass systems. Some of the lime remains unreacted following an initial pass through the spray chamber and is potentially available for further $SO_2$ collection. Solids collected in the ESP or baghouse may be mixed with water and reinjected in the spray chamber of the SDA along with the SDA reagent.

If the fuel sulfur content is low and/or the fuel contains enough alkalis, as is known to be the case for certain types of coal and oil shale, the ash particles themselves could serve as a source of reagent in the SDA. Typically, the alkali in fuel that can produce sufficient sulfur capture is calcium carbonate ($CaCO_3$).

Another example of ash particles being capable of serving as a reagent source in the SDA for capturing $SO_2$ is the ash from a circulating fluidized bed (CFB) boiler. This type of boiler typically utilizes limestone, which has as its predominant component calcium carbonate, fed to the furnace for in-furnace capture of $SO_2$ generated in the combustion process.

Whether part of the fuel or limestone, calcium carbonate in the furnace undergoes calcination, i.e. releases gaseous carbon dioxide and yields a solid calcium oxide, CaO, also known as lime:

$$CaCO_3 \rightarrow CaO + CO_2$$

The CaO reacts with $SO_2$ in the furnace gases thus producing calcium sulfate:

$$CaO + SO_2 + \tfrac{1}{2}O_2 \rightarrow CaSO_4$$

Calcium sulfate generated in the reaction covers the surface of the particle with a shell impenetrable for $SO_2$ thus stopping the reaction and rendering any CaO in its core unutilized.

In order to react with $SO_2$ in the SDA, the ash particles containing alkalis have to be reactivated. This can be done by wetting them with water spray. In such a case, instead of spraying lime slurry, water will be sprayed into the flue gas in the SDA.

A typical SDA process is as follows. The flue gas enters a spray dryer absorber where the gas stream is cooled by the reagent slurry or water spray. The mixture then passes on to the baghouse for removal of particulate before entering the induced draft fan and passing up the stack. If lime slurry is used as a reagent, pebble lime (CaO) is mixed with water at a controlled rate to maintain a high slaking temperature that helps generate fine hydrated lime ($Ca(OH)_2$) particles with high surface area in the hydrated lime slurry (18 to 25% solids). A portion of the flyash, unreacted lime and reaction products collected in the baghouse may be mixed with water and returned to the SDA as a high solids (35 to 45% typical) slurry. The remaining solids are directed to a storage silo for byproduct utilization or disposal. The fresh lime and recycle slurries (if any) are combined just prior to the atomizer(s) to enable fast response to changes in gas flow, inlet $SO_2$ concentrations, and $SO_2$ emissions as well as to minimize the potential for scaling.

$SO_2$ absorption in an SDA occurs in the individual slurry droplets or particles of wetted ash. Most of the reactions take place in the aqueous phase; the $SO_2$ and the alkaline constituents dissolve into the liquid phase where ionic reactions produce relatively insoluble products. The reaction path can be described as follows:

$$SO_2(g) \leftrightarrow SO_2(aq) \quad (a)$$

$$Ca(OH)_2(s) \rightarrow Ca^{+2} + 2OH^- \quad (b)$$

$$SO_2(aq) + H_2O \leftrightarrow HSO_3^- + H^+ \quad (c)$$

$$SO_2(aq) + OH^- \leftrightarrow HSO_3^- \quad (d)$$

$$OH^- + H^+ \leftrightarrow H_2O \quad (e)$$

$$HSO_3^- + OH^- \leftrightarrow SO_3^{-2} + H_2O \quad (f)$$

$$Ca^{+2} + SO_3^{-2} + \tfrac{1}{2}H_2O \rightarrow CaSO_3\tfrac{1}{2}H_2O(s) \quad (g)$$

The above reactions generally describe activity that takes place as heat transfer from the flue gas to the slurry droplet or wetted ash particle causes evaporation of the slurry droplet or the water from the surface of the wetted ash particle. Rapid $SO_2$ absorption occurs when liquid water is present. The drying rate can be slowed down to prolong this period of efficient $SO_2$ removal by adding deliquescent salts to the reagent feed slurry. Salts such as calcium chloride also increase the equilibrium moisture content of the end product. However, since the use of these additives alters the drying performance of the system, the operating conditions must be adjusted (generally increasing the approach temperature) to provide for good long-term operability of the SDA and the ash handling system. Ammonia injection upstream of a dry scrubber also increases $SO_2$ removal performance. $SO_2$ absorption continues at a slower rate by reaction with the solids in the downstream particulate collector.

An SDA/baghouse combination also provides efficient control of HCl, HF and $SO_3$ emissions by the summary reactions of:

$$Ca(OH)_2 + 2HCl \rightarrow CaCl_2 + 2H_2O \quad (1)$$

$$Ca(OH)_2 + 2HF \rightarrow CaF_2 + 2H_2O \quad (2)$$

$$Ca(OH)_2 + SO_3 \rightarrow CaSO_4 + H_2O \quad (3)$$

Proper accounting of the reagent consumption must include these side reactions, in addition to the $SO_2$ removed in the process.

Spray dryer absorbers (SDAs) can be a separate structure, or they can be an integrated part of the flue that precedes one or more particle collection devices, such as one or more baghouses or electrostatic precipitators. In either case the one or more SDAs should provide sufficient residence time for droplets of the lime slurry and/or water (sprayed for humidifying ash particles) to dry completely. Failure to do so results in the growth of cemented ash deposits on the walls of the one or more SDAs rendering them inoperable. Possible malfunctioning of the reagent distribution components, such as a plugging of the nozzles, can lead to a drastic increase in the coarseness of the reagent droplets. In such a case, even a very large SDA is not capable of accomplishing complete drying. Thus, the long-term reliability of such an SDA is compromised.

Therefore, there is a need in the art for a device and/or method for improving reliability of SDA operation while allowing reducing its size.

SUMMARY OF THE INVENTION

In the present invention, as will be explained in detail below, a low or no alkali-containing granular material is provided to one or more SDAs to improve reliability and/or compactness of the SDA.

The present invention generally relates to utilizing a spray dryer absorber downstream of a source of one or more acidic gases. In one embodiment, the present invention relates to improved spray dryer absorbers that are utilized in combination with a source of one or more acidic gases, such as a circulating fluidized bed (CFB) boiler.

In one embodiment, the present invention relates to a system for reducing the tendency for cementing in a spray dryer absorber. The system comprises at least one source of at least one gas, such at least one gas containing at least one acid compound, the concentration of which in the at least one gas has to be reduced. Also provided is at least one spray dryer absorber using at least one alkali-containing reagent for reacting with the at least one acid compound. In addition, at least one means for introducing at least one particulate compound into the at least one gas in combination with the at least one alkali-containing reagent, wherein the at least one particulate compound has a low or no alkali content, is provided.

In another embodiment, the present invention relates to a method of operating a system with a spray dryer absorber to reduce the tendency for cementing in the spray dryer absorber comprising the steps of: (A) providing at least one gas stream from at least one source, wherein the at least one gas stream contains at least one acid compound, which content has to be reduced; (B) providing a spray dryer absorber designed to receive the at least one gas stream from the at least one gas source, the spray dryer absorber using at least one alkali-containing reagent for reacting with the at least one acid compound; (C) providing at least one means for introducing at least one particulate compound into the at least one gas stream, wherein the at least one particulate compound has a low or no alkali content, to reduce the tendency for cementing in the spray dryer absorber during operation.

The various features of novelty which characterize the invention are pointed out with particularity in the claims annexed to and forming a part of this disclosure. For a better understanding of the invention, its operating advantages and the specific benefits attained by its uses, reference is made to the accompanying drawings and descriptive matter in which preferred embodiments of the invention are illustrated.

DESCRIPTION OF THE PREFERRED EMBODIMENT

Figure 1:
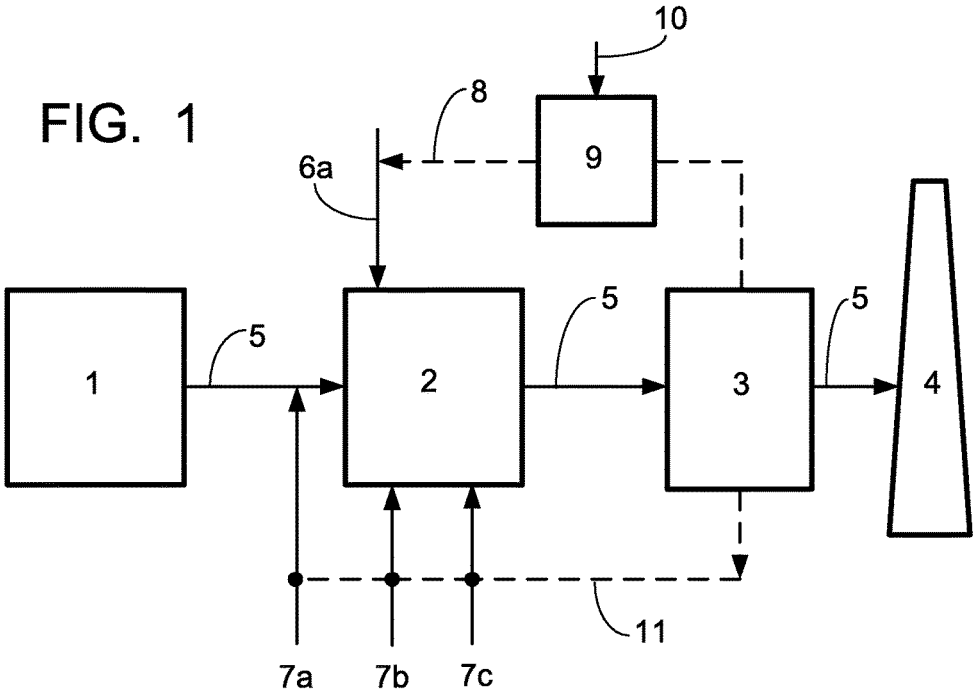
FIG. 1 is a simplified schematic illustration of a system according to the present invention when the alkali-containing reagent is injected into the gas stream from a source external to the gas stream, e.g. when the alkali-containing reagent is lime slurry.

Referring to the drawings generally, wherein like reference numerals designate the same or functionally similar elements throughout the several drawings, and to FIG. 1 in particular, the present invention relates to a spray dryer absorber (SDA) method and apparatus used to reduce the concentration of at least one acid compound contained in a gas. The SDA is provided downstream of a source of the gas.

In one embodiment, shown in FIG. 1, the system includes a source 1 of a gas containing at least one acid compound, the concentration of which in the gas has to be reduced; an SDA 2; a particulate collection device 3, e.g., fabric filter (baghouse) or electrostatic precipitator (ESP), and a stack 4. The gas source 1 can be a chemical reactor, a combustor, a boiler, etc. A gas stream 5 from the gas source 1 travels through the SDA 2, the particulate collection device 3 and on to the stack 4, from where it is released to the atmosphere. An alkali-containing reagent 6*a*, such as lime slurry, from an external source is injected into the gas stream 5 in the SDA 2 for reacting with the at least one acid compound in the gas stream 5. A low or no alkali-containing particulate compound, such as fly ash from another combustor, or sand, is injected into the gas stream 5 through injecting means which may be provided at one or more locations. A first location 7*a* may be provided upstream of the SDA 2. A second location 7*b* may be provided directly into the SDA 2 simultaneously with the injection of the alkali-containing reagent 6*a*. A third location 7*c* may be provided directly into the SDA 2, but downstream of the location where injection of the alkali-containing reagent 6*a* occurs. It is understood that any combination of locations 7*a*, 7*b* or 7*c* of the means for injecting the low or no alkali-containing particulate compound may be used in the practice of the present invention.

A portion of the particulate matter comprising fly ash, unreacted lime and reaction products collected in the particulate collection device 3 may be mixed in a hydrator 9 with water 10 for reactivating the unreacted lime and returning it to the SDA 2 via line 8 for introduction along with the alkali-containing reagent 6*a*. If the alkali content in the material collected in the particulate collection device 3 is low enough not to cause cementing when wetted, it can be recycled via line 11 and injected into the gas stream 5 alone or in combination with the low or no alkali-containing particulate compound through any combination of the injecting means locations 7*a*, 7*b* and 7*c*. The material may be recycled "as-is" from the particulate collection device 3 along the recycle line 11. The purpose of the recycle, as well as that of injecting the low or no alkali-containing particulate compound, is to use these particles to dilute the alkali-containing reagent for reducing its cementing potential. This improves reliability of the SDA and/or allows reducing its size.

Figure 2:
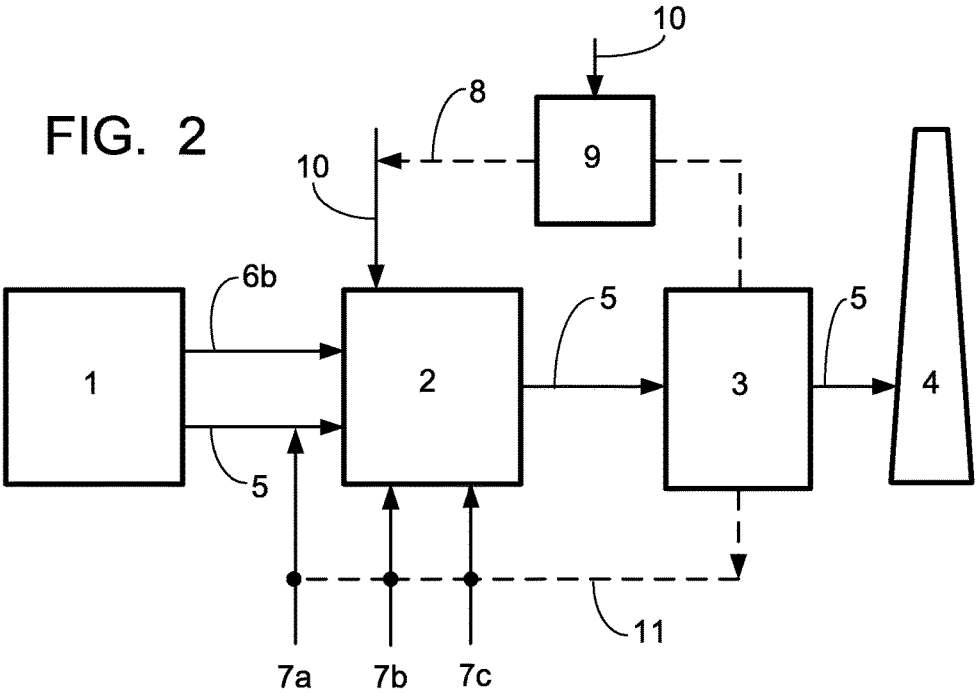
FIG. 2 is a simplified schematic illustration of a system according to the present invention when the alkali-containing reagent is introduced from the same source as the gas stream, e.g. when the alkali-containing reagent is fly ash from the combustor.

In another embodiment, shown in FIG. 2, the system includes a source 1 of a gas containing at least one acid compound, which content in the gas has to be reduced; a spray dryer absorber (SDA) 2, a particulate collection device 3 and a stack 4. The gas source 1 can again be a chemical reactor, a combustor, a boiler, etc. The gas stream 5 from the gas source 1 travels through the SDA 2, the particulate collection device 3 and to the stack 4, from where it is released to the atmosphere. An alkali-containing reagent 6*b* originates from the same source as the gas stream 5; e.g., it may be an alkali-containing fly ash from the combustor. (This may be the case when firing a fuel with low sulfur content and/or high alkali content, as in certain types of coal and oil shale. Another example of ash particles being capable of serving as a reagent in the SDA for reducing acid compounds in the flue gas is ash from a fluidized bed boiler, in particular from a circulating fluidized bed (CFB) boiler. This type of boiler typically utilizes limestone, which has as its predominant component calcium carbonate, fed to the furnace for in-furnace capture of $SO_2$ generated in the combustion process.) Water 10 is sprayed into the gas stream 5 in the SDA 2 for reactivating the alkali-containing fly ash, which then reacts with the at least one acid compound in the gas stream 5.

A low or no alkali-containing particulate compound, such as fly ash from another combustor, is injected into the gas stream 5 through the injecting means 7*a* upstream of the SDA 2 or the injecting means 7*b* in the SDA 2 simultaneously with injecting water 10 or the injecting means 7*c* in the SDA 2 downstream of injecting water 10 or any combination of the means 7*a*, 7*b* and 7*c*. A portion of the fly ash collected in the particulate collection device 3 may be mixed in the hydrator 9 with water 10 for reactivating the unreacted lime in the ash and returned to the SDA 2 via line 8 for introduction into the SDA along with the water 10. If the alkali content in the material collected in the particulate collection device 3 is low enough not to cause cementing when wetted, it can be recycled via line 11 and injected into the gas stream 5 alone or in combination with the low or no alkali-containing particulate compound through any combination of the injecting means 7*a*, 7*b* and 7*c*. The material may be recycled "as-is" from the particulate collection device 3 along the recycle line 11. The purpose of the recycle, as well as that of injecting the low or no alkali-containing particulate compound, is to use these particles to dilute the alkali-containing reagent for reducing its cementing potential. This improves reliability of the SDA and/or allows reducing its size.

As is noted above, the at least one low or no alkali-containing particulate compound can be injected upstream of the point, or points, where the alkali-containing reagent 6*a* or water 10 is injected into the SDA 2 (means 7*a* in FIG. 1 and FIG. 2, accordingly). This is a preferred location for injecting the low or no alkali-containing particulate compound since it improves the mixing of the compound with the reagent thus reduces the potential for cementing in the SDA 2. However, if required due to equipment constraints, the particulate compound can be injected concurrently with (means 7*b*) or downstream of (means 7*c*) the point, or points, at which the alkali-containing reagent 6*a* or water 10 is injected into the SDA 2.

Another aspect of the present invention relates to a method of operating a system with a spray dryer absorber comprising the steps of: (A) providing at least one gas stream from at least one source, wherein the at least one gas stream contains at least one acid compound, which content has to be reduced; (B) providing a spray dryer absorber designed to receive the at least one gas stream from the at least one gas source, the spray dryer absorber using at least one alkali-containing reagent for reacting with the at least one acid compound; (C) providing at least one means for introducing at least one particulate compound into the at least one gas stream, wherein the at least one particulate compound has a low or no alkali content; and (D) providing at least one particulate collection device collecting particulate matter in the at least one gas stream prior to its leaving the system.

In general, the acid compounds may be $SO_2$ and other sulfur compounds, such as $SO_3$ and $H_2SO_4$, as well as non-sulfur compounds, such as hydrogen chloride (HCl). The alkali-containing reagent may be calcium-based, sodium-based, etc.

In addition to cost reduction benefits, reducing the size of a spray dryer absorber (SDA) opens up the potential for using SDAs in spatially confined applications where larger equipment would be difficult or impossible to use. For example, the size reduction can be beneficial when retrofitting existing units.

Although the invention has been described in detail with particular reference to certain embodiments detailed herein, other embodiments can achieve the same results. For example, the present invention may be applied in new construction involving SDAs, or to the repair, replacement, and modification or retrofitting of existing SDAs. Variations and modifications of the present invention will be obvious to those skilled in the art and the present invention is intended to cover in the appended claims all such modifications and equivalents covered by the scope of the following claims.

I claim:

1. A system for reducing the tendency for cementing in a spray dryer absorber, comprising:

at least one source of at least one gas, such at least one gas containing at least one acid compound, the concentration of which in the at least one gas has to be reduced;

at least one spray dryer absorber for receiving the at least one gas and using at least one alkali-containing reagent for reacting with the at least one acid compound;

at least one as-is particulate recycle line designed to supply an as-is particulate from another combustor;

a particulate collection device located downstream of the at least one spray dryer absorber; and at least two means for injecting at least one particulate compound into the at least one gas in combination with the at least one alkali-containing reagent, wherein the at least one particulate compound is comprised of a low or no alkali particulate from the as-is particulate recycle line and has an alkali content that is low enough not to cause cementing in the spray dryer absorber during operation, wherein a first means of the at least two means for injecting the at least one particulate compound into the at least one gas is individually located upstream of the spray dryer absorber and wherein a second means of the at least two means for injecting the at least one particulate compound into the at least one gas is individually located in the at least one spray dryer absorber so that a combination with the individually injected at least one alkali-containing reagent is formed within the at least one spray dryer absorber due to the at least one second injection means, and wherein the low or no alkali content particulate compound is solely composed of as-is fly ash recycled directly from the particulate collection device and another combustor.

2. The system of claim 1, wherein the at least one gas comprises gas from a combustion process generated from a combustor located upstream of the at least one spray dryer absorber.

3. The system of claim 2, wherein the combustion process is conducted in a fluidized bed boiler.

4. The system of claim 3, wherein the combustion process is conducted in a circulating fluidized bed boiler.

5. The system of claim 1, wherein the alkali-containing reagent comprises a mixture of a reactivated reagent from a reactivating particulate line and a fresh reagent.

6. A method of operating a system with a spray dryer absorber to reduce the tendency for cementing in the spray dryer absorber, comprising the steps of:

(A) providing at least one gas stream from at least one source, wherein the at least one gas stream contains at least one acid compound, the concentration of which in the at least one gas stream has to be reduced;

(B) providing at least one spray dryer absorber designed to receive the at least one gas stream from the at least one gas source, the at least one spray dryer absorber using at least one alkali-containing reagent for reacting with the at least one acid compound;

(C) providing a particulate collection device located downstream of the at least one spray dryer absorber;

(D) at least one as-is particulate recycle line designed to supply an as-is particulate from the particulate collection device; and (E) providing at least two means for injecting at least one particulate compound into the at least one gas stream, wherein the at least one particulate compound is comprised of a low or no alkali particulate from the as-is particulate recycle line and has an alkali content that is low enough not to cause cementing in the spray dryer absorber during operation, wherein a first means of the at least two means for injecting the at least one particulate compound into the at least one gas is individually located upstream of the at least one spray dryer absorber, and wherein a second means of the at least two means for injecting the at least one particulate compound into the at least one gas is individually located within the at least one spray dryer absorber simultaneously with the at least one alkali-containing reagent or within the at least one spray dryer absorber downstream of the point at which the at least one alkali-containing reagent is provided the at least one spray dryer absorber so that a combination with the individually injected at least one alkali-containing reagent is formed within the at least one spray dryer absorber due to the at least one second injection means, and wherein the low or no alkali content particulate compound is solely composed of as-is fly ash recycled directly from the particulate collection device.

7. The method of claim 6, wherein there the at least one second injection means of Step (E) is located both within the at least one spray dryer absorber and thus the injection of the at least one particulate compound occurs simultaneously with providing the at least one alkali-containing reagent and within the at least one spray dryer absorber downstream of the point at which the at least one alkali-containing reagent is provided to and thus the injection of the at least one particulate compound occurs after providing the at least one alkali-containing reagent.

8. The method of claim 6, wherein the at least one gas stream comprises gas from a combustion process generated from a combustor located upstream of the at least one spray dryer absorber.

9. The method of claim 6, wherein the combustion process is conducted in a fluidized bed boiler.

10. The method of claim 9, wherein the combustion process is conducted in a circulating fluidized bed boiler.

11. The method of claim 6, wherein the alkali-containing reagent comprises a mixture of a reactivated reagent from the reactivating particulate line and a fresh reagent.

12. The method of claim 6, wherein the method further comprises a third injection means in Step (E) that is located within the at least one spray dryer absorber downstream of the point at which the at least one alkali-containing reagent is provided to and thus the injection of the at least one particulate compound occurs after the reaction of the at least one alkali-containing reagent with the at least one acid compound.

13. A system for reducing the tendency for cementing in a spray dryer absorber, comprising:

at least one source of at least one gas, such at least one gas containing at least one acid compound, the concentration of which in the at least one gas has to be reduced;

at least one spray dryer absorber for receiving the at least one gas and using at least one alkali-containing reagent for reacting with the at least one acid compound;

a particulate collection device located downstream of the at least one spray dryer absorber;

at least one as-is particulate recycle line designed to supply an as-is particulate from a another combustor; and at least two means for injecting at least one particulate compound into the at least one gas in combination with the at least one alkali-containing reagent, wherein the at least one particulate compound is comprised of a low or no alkali particulate from the as-is particulate recycle line and has an alkali content that is low enough not to cause cementing in the spray dryer absorber during operation, wherein one of the at least two means for injecting the at least one particulate compound into the at least one gas is individually located in the at least one spray dryer absorber so that a combination with the individually injected at least one alkali-containing reagent is formed within the at least one spray dryer absorber, wherein one of the at least two means for injecting the at least one particulate compound into the at least one gas in combination with the at least one alkali-containing reagent is located upstream of the spray dryer absorber, and wherein the low or no alkali content particulate compound is solely composed of as-is fly ash recycled directly from the particulate collection device and another combustor.

14. The system of claim 13, wherein the at least one gas comprises gas from a combustion process generated from a combustor located upstream of the at least one spray dryer absorber.

15. The system of claim 14, wherein the combustion process is conducted in a fluidized bed boiler.

16. The system of claim 13, wherein the alkali-containing reagent comprises lime slurry, fly ash, or a mixture thereof.

17. The system of claim 13, wherein the system further comprises:

at least three means for injecting at least one particulate compound into the at least one gas in combination with the at least one alkali-containing reagent, wherein the at least one particulate compound is comprised of a low or no alkali particulate from the as-is particulate recycle line to prevent cementing in the spray dryer absorber during operation, wherein one of the at least three means for injecting the at least one particulate compound into the at least one gas in combination with the at least one alkali-containing reagent is located upstream of the spray dryer absorber, wherein one of the at least three means for injecting the at least one particulate compound into the at least one gas in combination with the at least one alkali-containing reagent is located within the spray dryer absorber, and wherein one of the at least three means for injecting the at least one particulate compound into the at least one gas in combination with the at least one alkali-containing reagent is located downstream of the spray dryer absorber.

18. A system for reducing the tendency for cementing in a spray dryer absorber, comprising:

at least one source of at least one gas, such at least one gas containing at least one acid compound, the concentration of which in the at least one gas has to be reduced, wherein the at least one gas comprises a gas from a combustion process;

at least one spray dryer absorber for receiving the at least one gas and using at least one alkali-containing reagent for reacting with the at least one acid compound;

a particulate collection device located downstream of the at least one spray dryer absorber;

at least one as-is particulate recycle line designed to supply an as-is particulate from a another combustor; and at least one means for injecting at least one particulate compound into the at least one gas in combination with the at least one alkali-containing reagent, wherein the at least one particulate compound is comprised of a no alkali particulate from the as-is particulate recycle line and has no alkali content so as to not cause cementing in the spray dryer absorber during operation, wherein one of the at least one means for injecting the at least one particulate compound into the at least one gas is individually located in the at least one spray dryer absorber so that a combination with the individually injected at least one alkali-containing reagent is formed within the at least one spray dryer absorber, and wherein the low or no alkali content particulate compound is solely composed of as-is fly ash recycled directly from the particulate collection device and another combustor.

19. A system for reducing the tendency for cementing in a spray dryer absorber, comprising:

at least one source of at least one gas, such at least one gas containing at least one acid compound, the concentration of which in the at least one gas has to be reduced;

at least one spray dryer absorber for receiving the at least one gas and using at least one alkali-containing reagent for reacting with the at least one acid compound;

a particulate collection device located downstream of the at least one spray dryer absorber;

at least one as-is particulate recycle line designed to supply an as-is particulate from a another combustor; and at least three means for injecting at least one particulate compound into the at least one gas in combination with the at least one alkali-containing reagent, wherein the at least one particulate compound is comprised of a low or no alkali particulate from the as-is particulate recycle line and has an alkali content that is low enough not to cause cementing in the spray dryer absorber during operation, wherein one of the at least three means for injecting the at least one particulate compound into the at least one gas in combination with the at least one alkali-containing reagent are individually located near to one another in the at least one spray dryer absorber so that a combination with the individually injected at least one alkali-containing reagent is formed within the at least one spray dryer absorber, wherein one of the at least three means for injecting the at least one particulate compound into the at least one gas in combination with the at least one alkali-containing reagent is located upstream of the spray dryer absorber, wherein one of the at least three means for injecting the at least one particulate compound into the at least one gas in combination with the at least one alkali-containing reagent is located within the at least one spray dryer absorber downstream of the point at which the at least one alkali-containing reagent is provided to and thus the injection of the at least one particulate compound occurs after the providing of the at least one alkali-containing reagent, wherein the low or no alkali content particulate compound is solely composed of as-is fly ash recycled directly from the particulate collection device and another combustor, and wherein the alkali-containing reagent comprises lime slurry, fly ash, or a mixture thereof.

* * * * *